US006093688A

United States Patent [19]

Gordon

[11] Patent Number: 6,093,688

[45] Date of Patent: Jul. 25, 2000

[54] WATER SOFTENING AND DETERGENT COMPOSITIONS

[75] Inventor: James William Gordon, Ulverston, United Kingdom

[73] Assignee: Unilever Home & Personal Care USA, Greenwich, Conn.

[21] Appl. No.: 09/280,325

[22] Filed: Mar. 29, 1999

[30] Foreign Application Priority Data

Apr. 15, 1998 [GB] United Kingdom ..... 9807992

[51] Int. Cl.[7] ..... C11D 3/12; C11D 3/20; C11D 7/20; C11D 11/00; C11D 17/00

[52] U.S. Cl. ..... 510/224; 510/294; 510/298; 510/334; 510/349; 510/488; 510/507; 510/441; 510/446; 252/175; 252/179

[58] Field of Search ..... 510/294, 224, 510/298, 334, 349, 441, 446, 488, 507; 252/175, 176, 179

[56] References Cited

U.S. PATENT DOCUMENTS

| | | | |
|---|---|---|---|
| 3,953,350 | 4/1976 | Fujino et al. | 252/94 |
| 4,219,435 | 8/1980 | Biard et al. | 510/439 |
| 4,587,031 | 5/1986 | Kruse et al. | 510/224 |
| 4,642,197 | 2/1987 | Kruse et al. | 252/98 |
| 5,866,531 | 2/1999 | Assmann et al. | 510/446 |
| 5,914,309 | 6/1999 | Ulbl et al. | 510/446 |

FOREIGN PATENT DOCUMENTS

| | | |
|---|---|---|
| 002 293 | 6/1979 | European Pat. Off. . |
| 482 627 | 4/1992 | European Pat. Off. . |
| 522 766 | 1/1993 | European Pat. Off. . |
| 711 827 | 5/1996 | European Pat. Off. . |
| 838 519 | 4/1998 | European Pat. Off. . |
| 196 37 606 | 3/1998 | Germany . |
| 60-15500 | 1/1985 | Japan . |
| 06/122900 | 5/1994 | Japan . |
| 911204 | 11/1962 | United Kingdom . |
| 90/02165 | 3/1990 | WIPO . |
| 96/06156 | 2/1996 | WIPO . |

OTHER PUBLICATIONS

Derwent abstract of JP 60135497, Jul. 18, 1985.
Derwent abstract of JP 60135498, Jul. 18, 1985.

*Primary Examiner*—Lorna M. Douyon
*Attorney, Agent, or Firm*—Rimma Mitelman

[57] ABSTRACT

The speed of disintegration of tablets containing a water-softening agent, especially water-insoluble, water-softening agent intended as detergency builder for fabric washing is enhanced by incorporating sodium acetate trihydrate, potassium acetate or a mixture thereof. To inhibit caking and facilitate handling during manufacture, smaller particles of another substance are preferably provided at the surface of the crystals of the acetate or citrate.

18 Claims, No Drawings

WATER SOFTENING AND DETERGENT COMPOSITIONS

FIELD OF THE INVENTION

This invention relates to compositions in the form of tablets, containing a water-softening agent. These tablets may be embodied as detergent compositions for use in fabric washing, or as water-softening tablets, which could be used in fabric washing jointly with a composition containing detergent active, or could possibly be used in other applications, e.g. in machine dishwashing as an anti-limescale product. The invention is concerned with tablets which are intended to disintegrate, usually in less than 15 minutes, when placed in water, so that the tablets are consumed when carrying out a single washing operation.

BACKGROUND AND SUMMARY OF PRIOR ART

Detergent compositions in tablet form are described, for example, in GB 911204 (Unilever), U.S. Pat. No. 3,953,350 (Kao), JP 60-015500A (Lion), JP 60-135497A (Lion) and JP 60-135498A (Lion); and are sold commercially in Europe. Tablets have several advantages over powdered products: they do not require measuring and are thus easier to handle and dispense into the washload, and they are more compact, hence facilitating more economical storage.

Detergent tablets are generally made by compressing or compacting a detergent powder, which includes detergent active and detergency builder. EP-A-522766 explains that difficulty has been found in providing tablets which have adequate strength when dry, yet disperse and dissolve quickly when added to wash water. The problem has proved especially difficult with compositions containing insoluble aluminosilicate as detergency builder, but the problem also arises with tablets which contain sodium tripolyphophate as the detergency builder.

This prior document teaches that at least some particles of the composition should be coated with a binder which helps to hold the tablet together and allows a tablet to be made using a lower compaction pressure. The binder can also function as a disintegrant.

U.S. Pat. No. 4,642,197 teaches that the effect of selected tablet disintegration agents in a washing additive tablet may be enhanced by the addition of not more than 7% by weight of an alkali metal salt of short-chain organic mono- or polycarboxylic acid. Sodium acetate and sodium citrate are named.

EP-A-482627 teaches that a detergent composition for compaction into tablets with improved solubility should include potassium carbonate together with nonionic surfactant.

EP-A-711827 teaches that speed of disintegration of tablets can be improved by including a highly water-soluble citrate. Tablet compositions exemplified in that document include sodium citrate dihydrate and also polyethylene glycol as an organic polymeric binder. This document also mentions that sodium acetate can be included in a composition as a lubricant to aid tableting. The trihydrate of sodium acetate is not named. The amount of lubricant is not stated, but it would be appropriate to include only a small amount.

WO 90/02165 mentions a range of materials including sodium acetate trihydrate as tableting aids, preferably used as a small percentage of the composition and preferably of fine particle size. A range of possible functions is attributed indiscriminately to these tableting aids.

SUMMARY OF THE INVENTION

Surprisingly, we have now found that the speed of disintegration of tablets can be enhanced by including sodium acetate trihydrate. This material has been found to be more effective than some other materials, including sodium citrate dihydrate, even without polymeric binder present. Moreover, we have found that sodium acetate trihydrate can be included without detriment to tablet strength. Indeed we have observed enhancements in tablet strength. Potassium acetate has also been found to be remarkably effective.

In a first aspect, the present invention provides a tablet of a compacted particulate composition wherein the tablet or a region thereof comprises first particles which contain a water-softening agent and second particles which contain sodium acetate trihydrate, potassium acetate or a mixture of them, where the second particles are separate from but mixed with the first particles.

The amount of water-softening agent will generally be at least 15% by weight of the composition. Depending on the function for which the tablets are intended the amount may range up to 90 or 93% by weight. In significant forms of this invention there is at least 15%, by weight of the composition, of a water-insoluble water softening agent.

The amount of the sodium acetate trihydrate or potassium acetate or mixture of the two is 10% by weight of the composition, often at least 13% by weight. The amount will not exceed 35% by weight of the composition and frequently will not exceed 25% or 30% by weight of the composition.

It is possible that the sodium acetate trihydrate or potassium acetate might be used jointly with sodium citrate dihydrate because sodium citrate dihydrate may function as a water-soluble water softening agent/detergency builder as well as enhancing the speed of disintegration of a tablet in water. Thus the composition of a tablet or region thereof might contain from 10% up to 20% or more of sodium acetate trihydrate or potassium acetate or a mixture of the two, accompanied by 5% to 20% by weight of sodium citrate dihydrate.

The invention includes a process for making tablets by mixing particles containing the water-softening agent with second particles containing the crystalline salt and then compacting the resulting composition to form a tablet or a region of a tablet.

We have now found, however, that when sodium acetate trihydrate, potassium acetate and mixtures thereof are handled on a commercial scale, they have a tendency to cake into inconvenient lumps even though they are simple crystalline solids. We have found that this problem, which we believe has not previously been recognised, can be reduced by applying finely divided particulate material to the exterior of the crystals. Moreover, the benefit of improved speed of disintegration is substantially retained.

Accordingly, in another aspect, this invention provides a process for the production of a tablet of a compacted particulate composition by mixing (i) first particles containing a water-softening agent, and (ii) second particles containing a water-soluble crystalline salt selected from sodium acetate trihydrate, potassium acetate and mixtures thereof and compacting the resulting mixed composition into tablets or regions of tablets, characterised by the presence of particles of another substance at the surface of the crystals of the said crystalline salt (ii) before it is mixed with the water softening agent (i).

In a second aspect this invention provides a tablet of compacted particulate composition containing a water-softening agent mixed with a crystalline salt selected from sodium citrate dihydrate, sodium acetate trihydrate, potassium acetate and mixtures thereof characterised by particles of another material at the surface of the crystals of the said crystalline salt.

The process may include a step of application of particles of material to the surface of crystals of the crystalline salt. However, this step may be carried out by the manufacturer of that salt, at the place and time of its production, prior to transport to the place where the tablets are made by mixing and compaction.

DETAILED DESCRIPTION AND EMBODIMENT

This invention utilises crystals of sodium acetate trihydrate, potassium acetate or mixture of them, preferably bearing particles of another substance at the surface of the crystals of the said salt, in a tablet of compacted particulate composition or a region thereof, to enhance the disintegration of the tablet in water.

The amount of the sodium acetate trihydrate, potassium acetate or mixture of them, is at least 10% by weight of the composition, often at least 13% by weight. It will generally not exceed 35% by weight of the composition and frequently will not exceed 25% or 30% by weight of the composition.

Although potassium acetate is very effective, it is hygroscopic. We have found it easier to use sodium acetate trihydrate which is therefore the material of preference. If a mixture of these materials is used, it is preferred that sodium acetate trihydrate provides at least 5% by weight of the composition which is compacted into a tablet or region of a tablet.

It is strongly preferred that the potassium acetate, sodium acetate trihydrate and/or mixture thereof have a mean particle size of above 250 μm, preferably above 300 μm (0.3 mm), better above 500 μm (0.5 mm) to facilitate flow and handling of the particulate composition prior to and during compaction. The particle size will probably have a mean value less than 2 mm, preferably less than 1 mm. Poor powder flow is disadvantageous, inter alia, in that it leads to irregular filling of dies and inconsistent tablet weight and strength.

If another material is present at the surface of the crystals it suitably has a smaller particle size than the crystals. The mean particle size of this material may be no more than 180 μm or 100 μm. With some materials the mean particle size may be no more than 20 μm and it may be no more than 10 μm or 5 μm, especially if it is water-insoluble. Thus the material on the surface of the crystals may have a mean particle size which is not more than one tenth or one thirtieth the mean size of the crystals.

A number of substances have been found suitable for application to the surface of particles of the crystalline salt. Materials which have found to be suitable include alkali metal carbonate and bicarbonates, sodium aluminosilicates and particles of polyethylene glycol.

Particles of sodium aluminosilicate are particularly preferred because they function as a water-softening agent when the composition is used.

Water-Softening Agent

It is particularly envisaged that this invention will be applied to tablets containing water-insoluble water softening agent, notably alkali-metal aluminosilicate. However, it could be applied in tablets containing a soluble water-softening agent such as a condensed phosphate. It could be applied in tablets containing both soluble and insoluble water softening agents—as might be used in countries where a restricted quantity of phosphate detergency builder is permitted.

It is very well known that water-insoluble alkali metal aluminosilicates can function to soften water, removing calcium ions and to a lesser extent magnesium ions by ion exchange. Aluminosilicates have become strongly favoured as environmentally acceptable detergency builders.

Alkali metal (preferably sodium) aluminosilicates used in tablets of the present invention may be either crystalline, amorphous or a mixture of the two. Such aluminosilicates generally have a calcium ion exchange capacity of at least 50 mg CaO per gram of aluminosilicate, comply with a general formula:

$$0.8\text{–}1.5\ Na_2O.Al_2O_3.0.8\text{–}6\ SiO_2$$

and incorporate some water. Preferred sodium aluminosilicates within the above formula contain 1.5–3.5 $SiO_2$ units. Both amorphous and crystalline aluminosilicates can be prepared by reaction between sodium silicate and sodium aluminate, as amply described in the literature.

Suitable crystalline sodium aluminosilicate ion-exchange detergency builders are described, for example, in GB 1429143 (Procter & Gamble) . The preferred sodium aluminosilicates of this type are the well known commercially available zeolites A and X, and mixtures thereof. Also of interest is the novel zeolite P described and claimed in EP 384070 (Unilever).

Another category of water-insoluble material which can function as a water-softening agent and detergency builder is the layered sodium silicate builders disclosed in U.S. Pat. No. 4,464,839 and U.S. Pat. No. 4,820,439 and also referred to in EP-A-551375.

These materials are defined in U.S. Pat. No. 4,820,439 as being crystalline layered sodium silicate of the general formula $$NaMSi_x0_{2x+1}.YH_2O$$

where

M denotes sodium or hydrogen, x is from 1.9 to 4 and y is from 0 to 20.

Quoted literature references describing the preparation of such materials include Glastechn. Ber. 37, 194–200 (1964), Zeitschrift für Kristallogr. 129, 396–404 (1969), Bull. Soc. Franc. Min. Crist., 95, 371–382 (1972) and Amer. Mineral, 62, 763–771 (1977). These materials also function to remove calcium and magnesium ions from water.

It is customary to use a water-soluble builder (water-softening agent) jointly with aluminosilicate, to enhance water-softening efficacy. Such water-soluble co-builders are generally used in an amount which is not greater than the amount of aluminosilicate, often less than half the amount of aluminosilicate. Water-soluble builders may be organic or inorganic. Inorganic builders that may be present include alkali metal (generally sodium) carbonate; while organic builders include polycarboxylate polymers, such as polyacrylates, acrylic/maleic copolymers, and acrylic phosphonates, monomeric polycarboxylates such as citrates, gluconates, oxydisuccinates, glycerol mono- di- and trisuccinates, carboxymethyloxysuccinates, carboxymethyloxymalonates, dipicolinates and hydroxyethyliminodiacetates.

Especially preferred supplementary builders are polycarboxylate polymers, more especially polyacrylates and acrylic/maleic copolymers, and monomeric polycarboxylates, more especially citric acid and its salts.

If a tablet contains only soluble water-softening agent, this may well be sodium tripolyphosphate, which is widely used as a detergency builder in some countries.

When using aluminosilicate or other insoluble detergency builder/water-softening agent it is often a commercial or legislative requirement to avoid phosphates. Some tablet compositions of the invention do not contain more than 5 wt % of inorganic phosphate builders, and are desirably substantially free of phosphate builders. However, tableted compositions containing some phosphate builder are also within the broad scope of the invention. In particular, a tablet or region thereof may contain at least 15 wt % insoluble water softening agent, with phosphate or other water-soluble builder in addition.

As mentioned above, compositions of this invention may be embodied as detergent compositions for use in fabric washing, in which case the composition will generally contain from 15 to 60% by weight of detergency builder, notably water-insoluble aluminosilicate, together with 5 to 500 by weight of one or more detergent-active compounds. Such a composition may well contain from 0.5 to 15% by weight of a supplementary builder, notably polycarboxylate, and also other detergency ingredients.

Tablets for use in fabric washing may in particular be used when washing in an automatic washing machine and will disintegrate and be consumed in a single machine cycle.

Another possibility is that the invention may be embodied in tablets whose principal or sole function is that of removing water hardness. In such tablets the water-softening agents, especially water-insoluble aluminosilicate, may provide from 50 to 98% of the tablet composition. A water-soluble supplementary builder may well be included, for instance in an amount from 2% to 30 wt % of the composition.

Water-softening tablets embodying this invention may include some detergent active. Notably, water-softening tablets may include nonionic surfactant which can act as a lubricant during tablet manufacture and as a low foaming detergent during use. The amount may be small, e.g. from 0.2 or 0.5% by weight of the composition up to 3% or 5% by weight.

Detergent Tablets

Tablets for use in fabric washing will generally contain from 5% to 50% by weight of detergent active, preferably from 5% or 9 wt % up to 40 % or 50 wt %. Detergent-active material present may be anionic (soap or non-soap), cationic, zwitterionic, amphoteric, nonionic or any combination of these.

Anionic detergent-active compounds may be present in an amount of from 0.5 to 40 wt %, preferably from 2% or 4% to 30% or 40 wt %.

Synthetic (i.e. non-soap) anionic surfactants are well known to those skilled in the art. Examples include alkylbenzene sulphonates, particularly sodium linear alkylbenzene sulphonates having an alkyl chain length of $C_8$–$C_{15}$; olefin sulphonates; alkane sulphonates; dialkyl sulphosuccinates; and fatty acid ester sulphonates.

Primary alkyl sulphate having the formula $$ROSO_3^-M^+$$

in which R is an alkyl or alkenyl chain of 8 to 18 carbon atoms especially 10 to 14 carbon atoms and $M^+$ is a solubilising cation, is commercially significant as an anionic detergent active. It is frequently the desired anionic detergent and may provide 75 to 100% of any anionic non-soap detergent in the composition.

In some forms of this invention the amount of non-soap anionic detergent lies in a range from 0.5 to 15 wt % of the tablet composition.

It may also be desirable to include one or more soaps of fatty acids. These are preferably sodium soaps derived from naturally occurring fatty acids, for example, the fatty acids from coconut oil, beef tallow, sunflower or hardened rapeseed oil.

Suitable nonionic detergent compounds which may be used include in particular the reaction products of compounds having a hydrophobic group and a reactive hydrogen atom, for example, aliphatic alcohols, acids, amides or alkyl phenols with alkylene oxides, especially ethylene oxide either alone or with propylene oxide.

Specific nonionic detergent compounds are alkyl ($C_{8-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylene-diamine. Other nonionic detergent compounds include alkylpolyglycosides, long-chain amine oxides, tertiary phosphine oxides, and dialkyl sulphoxides.

Especially preferred are the primary and secondary alcohol ethoxylates, especially the $C_{9-11}$ and $C_{12-15}$ primary and secondary alcohols ethoxylated with an average of from 5 to 20 moles of ethylene oxide per mole of alcohol.

In certain forms of this invention the amount of nonionic detergent lies in a range from 4 to 40%, better 4 or 5 to 30% by weight of the composition.

Many nonionic detergent-active compounds are liquids. These may be absorbed on a porous carrier. Preferred carriers include zeolite; zeolite granules with other materials, for example Wessalith CS (Trade Mark), Wessalith CD (Trade Mark) or Vegabond GB (Trade Mark); sodium perborate monohydrate; Burkeite (spray-dried sodium carbonate and sodium sulphate as disclosed in EP-A-221776 of Unilever); and layered sodium silicate as described in U.S. Pat. No. 4,664,839.

Bleach System

Tableted detergent compositions according to the invention may contain a bleach system. This preferably comprises one or more peroxy bleach compounds, for example, inorganic persalts or organic peroxyacids, which may be employed in conjunction with activators to improve bleaching action at low wash temperatures. If any peroxygen compound is present, the amount is likely to lie in a range from 10 to 25% by weight of the composition.

Preferred inorganic persalts are sodium perborate monohydrate and tetrahydrate, and sodium percarbonate, advantageously employed together with an activator. Bleach activators, also referred to as bleach precursors, have been widely disclosed in the art. Preferred examples include peracetic acid precursors, for example, tetraacetylethylene diamine (TAED), now in widespread commercial use in conjunction with sodium perborate; and perbenzoic acid precursors. The quaternary ammonium and phosphonium bleach activators disclosed in U.S. Pat. No. 4,751,015 and U.S. Pat. No. 4,818,426 (Lever Brothers Company) are also of interest. Another type of bleach activator which may be used, but which is not a bleach precursor, is a transition metal catalyst as disclosed in EP-A-458397, EP-A-458398 and EP-A-549272. A bleach system may also include a bleach stabiliser (heavy metal sequestrant) such as ethylenediamine tetramethylene phosphonate and diethylenetriamine pentamethylene phosphonate.

As indicated above, if a bleach is present and is a water-soluble inorganic peroxygen bleach, the amount may well be from 10% to 25% by weight of the composition.

Other Ingredients

Detergent tablets of the invention may also contain one of the detergency enzymes well known in the art for their ability to degrade and aid in the removal of various soils and stains. Suitable enzymes include the various proteases, cellulases, lipases, amylases, and mixtures thereof, which are designed to remove a variety of soils and stains from fabrics. Examples of suitable proteases are Maxatase (Trade Mark), as supplied by Gist-Brocades N.V., Delft, Holland, and Alcalase (Trade Mark), and Savinase (Trade Mark), as supplied by Novo Industri A/S, Copenhagen, Denmark. Detergency enzymes are commonly employed in the form of granules or marumes, optionally with a protective coating, in amount of from about 0.1% to about 3.0% by weight of the composition; and these granules or marumes present no problems with respect to compaction to form a tablet.

The detergent tablets of the invention may also contain a fluorescer (optical brightener), for example, Tinopal (Trade Mark) DMS or Tinopal CBS available from Ciba-Geigy AG, Basel, Switzerland. Tinopal DMS is disodium 4,4'bis-(2-morpholino-4-anilino-s-triazin-6-ylamino) stilbene disulphonate; and Tinopal CBS is disodium 2,2'-bis-(phenylstyryl) disulphonate.

An antifoam material is advantageously included, especially if the detergent tablet is primarily intended for use in front-loading drum-type automatic washing machines. Suitable antifoam materials are usually in granular form, such as those described in EP 266863A (Unilever). Such antifoam granules typically comprise a mixture of silicone oil, petroleum jelly, hydrophobic silica and alkyl phosphate as antifoam active material, sorbed onto a porous absorbed water-soluble carbonate-based inorganic carrier material. Antifoam granules may be present in an amount up to 5% by weight of the composition.

It may also be desirable that a detergent tablet of the invention includes an amount of an alkali metal silicate, particularly sodium ortho-, meta- or preferably alkali metal silicates at levels, for example, of 0.1 to 10 wt %, may be advantageous in providing protection against the corrosion of metal parts in washing machines, besides providing some measure of building and giving processing benefits.

Further ingredients which can optionally be employed in the detergent tablet of the invention include anti-redeposition agents such as sodium carboxymethylcellulose, straight-chain polyvinyl pyrrolidone and the cellulose ethers such as methyl cellulose and ethyl hydroxyethyl cellulose, fabric-softening agents; heavy metal sequestrants such as EDTA; perfumes; colourants or coloured speckles, and tableting aids such as binders and lubricants.

The particulate mixed composition which is compacted into tablets may in principle have any bulk density. However, the present invention is especially relevant to tablets made by compacting powders of relatively high bulk density, because of their greater tendency to exhibit disintegration and dispersion problems. Such tablets have the advantage that, as compared with a tablet derived from a low bulk density powder, a given dose of composition can be presented as a smaller tablet.

Thus the starting particulate composition may suitably have a bulk density of at least 400 g/liter, preferably at least 500 g/liter, and advantageously at least 700 g/liter.

A tablet of the invention may be either homogeneous or heterogeneous. In the present specification, the term "homogeneous" is used to mean a tablet produced by compaction of a single particulate composition, but does not imply that all the particles of that composition will necessarily be of identical composition. Indeed it is likely that the composition will contain the sodium acetate trihydrate or potassium acetate as separate particles.

The term "heterogeneous" is used to mean a tablet consisting of a plurality of discrete regions, for example layers, inserts or coatings, each derived by compaction from a particulate composition and large enough to constitute from 10 to 90% of the weight of the whole tablet.

It is possible that the potassium acetate or sodium acetate trihydrate will be contained within one or more but not all such discrete regions of a heterogeneous tablet, such as a layer or an insert. The presence of such a layer or insert could assist break up of the entire tablet when placed in water.

Tableting

Tableting entails compaction of a particulate composition.

A variety of tableting machinery is known, and can be used. Generally it will function by stamping a quantity of the particulate composition which is confined in a die.

Tableting may be carried out at ambient temperature or at a temperature above ambient which may allow adequate strength to be achieved with less applied pressure during compaction. In order to carry out the tableting at a temperature which is above ambient, the particulate composition is preferably supplied to the tableting machinery at an elevated temperature. This will of course supply heat to the tableting machinery, but the machinery may be heated in some other way also.

If any heat is supplied, it is envisaged that this will be supplied conventionally, such as by passing the particulate composition through an oven, rather than by any application of microwave energy. However, this invention could be utilised in a process in which the tableting step includes application of microwave energy to the composition.

EXAMPLE 1

Tablets suitable for use in water-softening were made from mixtures of zeolite granules and sodium acetate trihydrate.

The zeolite granules were a commercial product available from Norsohaas under designation WLZ-10. Their composition was:

| | |
|---|---|
| Polycarboxylate | 9–11% |
| Zeolite A | 69.5–73.5% |
| Water | 17–20% |

The polycarboxylate was a copolymer of acrylate and maleate. Such polymers are known as water-soluble builders which enhance the water-softening efficacy of zeolite and also inhibit redeposition of soil from a wash liquor. In these granules the polycarboxylate serves as a binder for the zeolite powder.

The granulometry of WLZ-10 was determined as:

| | |
|---|---|
| Rosin Rammler average particle size | 625 microns |
| Rosin Rammler N value | 1.88 |
| Bulk density | 777 kg/m$^3$ |

The sodium acetate trihydrate was available from Merck and its granulometry was determined as:

| | |
|---|---|
| Rosin Rammler average particle size | 625 microns |
| Rosin Rammler N value | 2.31 |

Size distribution

| | |
|---|---|
| <180 μm | 4.41% |
| <250 μm | 10.28% |
| <500 μm | 48.03% |
| >500 μm | balance |

The WLZ-10 zeolite granules and the sodium acetate trihydrate were dry mixed in various proportions, and then 2 gram portions of each mixture were stamped into tablets of 13.1 mm diameter using a Carver hard press with an applied force of 20 kN.

The strength of the tablets, in their dry state as made on the press, was determined as the force, expressed in Newtons, needed to break the tablet, as measured using a Chatillon type universal testing instrument in a direction perpendicular to the direction of compression.

The speed of dissolution of the tablets was measured by a test procedure in which two of the tablets are placed on a plastic sieve with 2 mm mesh size which was immersed in 9 liters of demineralised water at ambient temperature of 22° C. and rotated at 200 rpm. The water conductivity was monitored over a period of 30 minutes or until it reached a constant value.

The time for break up and dispersion of the tablets was taken as the time for change in the water conductivity to reach 90% of its final magnitude. This was also confirmed by visual observation of the material remaining on the rotating sieve.

The results are set out in the following table:

| % WLZ-10 | % Na-acetate 3 aq. | Strength (N) | Dissolution (mins) |
|---|---|---|---|
| 100 | 0 | 157.5 | 7.0 |
| 90 | 10 | 214.5 | 6.8 |
| 80 | 20 | 197.50 | 3.2 |
| 75 | 25 | 275 | 1.6 |
| 0 | 100 | 199 | 2.8 |

It is apparent from the table above that incorporation of sodium acetate trihydrate leads to faster break-up and dispersion of the tablets. Moreover, this is accompanied by an increase in strength. Even more surprisingly there is a synergistic effect; a mixture provides the best strength and speed of dispersion.

Comparative

A number of other water-soluble salts were used in place of sodium acetate trihydrate, at proportions of 80 wt % WLZ-10 to 20 wt % of the salt. The results are shown in the table below:

| | Solubility g/100 g (20° C.) | Strength (N) | Dissolution (mins) |
|---|---|---|---|
| No additive | | 157.5 | 7.0 |
| Na-acetate 3 aq. | 76.2 | 197.5 | 3.2 |
| Na-acetate 0 aq. | 119 | 289.5 | 9.8 |
| Na-citrate 2 aq. | 72$^{(25° C.)}$ | 115 | 4.2 |
| K carbonate 1.5 aq. | | 79 | 5.8 |
| Mg sulphate 7 aq. | 71 | | 30 |

As can be seen from the table, only sodium acetate trihydrate gave an increase in strength with a reduction in the time for break-up and dispersion.

Sodium citrate dihydrate gives a reduction in dissolution time, but this is accompanied by a reduction in strength.

EXAMPLE 2

Tablets were made as in Example 11 using sodium acetate trihydrate which had been sieved to give narrower ranges of particle size. The proportions of WLZ-10 and sodium acetate trihydrate were 80 wt %:20 wt %.

As a comparison, tablets were made in the same way, using sodium citrate dihydrate which had been sieved to give similar ranges of particle size. Results are set out in the following table which shows that sodium acetate trihydrate was consistently superior.

| | Strength (N) | | T 90% (mins) | |
|---|---|---|---|---|
| Particle size (μm) | Na-citrate 2 aq. | Na-acetate 3 aq. | Na-citrate 2 aq. | Na-acetate 3 aq. |
| >1000 μm | 122.5 | 178.5 | 5.1 | 4.8 |
| 710–1000 μm | 145 | 187.5 | 6.2 | 4.1 |
| 355–710 μm | 174.5 | 208.5 | 5.55 | 4.15 |
| <355 μm | 109 | 210.5 | 5.15 | 3.75 |

EXAMPLE 3

Tablets for use in fabric washing were made, starting with a base powder of the following composition:

| | |
|---|---|
| Coconut alkyl sulphate[1] | 2.9% |
| Zeolite A24[2] | 52.9% |
| Sodium carbonate | 0.7% |
| Nonionic detergent[3] | 25.9% |
| Soap | 5.9% |
| Sodium carboxymethyl cellulose | 1.4% |
| Fluorescer | 0.4% |
| Acrylate/maleate copolymer | 0.7% |

[1]The coconut alkyl sulphate was incorporated as preformed granules containing 45% coconut alkyl sulphate, 35% zeolite, 11% sodium carbonate, balance water and other salts.
[2]Maximum aluminium zeolite P from Crosfields.
[3]$C_{13-15}$ fatty alcohol 7EO.

This powder was mixed with sodium acetate trihydrate (from Merck as used in Example 1) and other detergent ingredients as tabulated below. As a comparative composition the base powder was mixed with sodium citrate dihydrate and other detergent ingredients and then sprayed with polyethylene glycol (Molecular Weight 1500) at 80° C.

The two compositions thus contained:

| | A (with Na-acetate 3 aq). parts by weight | B (comparative) parts by weight |
|---|---|---|
| Base powder | 53.02 | 53.02 |
| Na-perborate 4 aq. | 19.99 | 19.99 |
| TAED granules | 4.49 | 4.49 |
| Anti-foam granule | 3.42 | 3.42 |
| Enzymes | 1.5 | 1.5 |
| Phosphonate | 1.0 | 1.0 |
| Perfume | 0.43 | 0.43 |
| Na-acetate 3 aq. | 16.13 | |
| Silicate-carbonate co-granule | | 5.5 |
| Na-citrate 2 aq. | | 8.03 |
| PEG 1500 | | 2.5 |

35 g portions of each composition were made into cylindrical tablets of 44 mm diameter, using a Carver hand press with various levels of compaction force.

The strength of these tablets was measured by means of the following procedure carried out using an Instrom universal testing machine to compress a tablet until fracture.

A tablet was placed between the platens of the Instrom materials testing machine so that these are at either end of a diametral plane through the cylindrical tablet. The machine applies force to compress the tablet until the tablet fractures. The testing machine measures the applied force (F), and also the displacement (x) of the platens towards each other as the tablet is compressed. The distance (y) between the platens before force is applied, which is the diameter of the tablet, is also known. The maximum force applied is the force at failure ($F_f$). From this measurement of force a test parameter called diametral fracture stress, can be calculated using the equation $$\sigma = \frac{2F_f}{\pi D t}$$

where σ is the diametral fracture stress in Pascals, $F_f$ is the applied force in Newtons to cause fracture, D is the tablet diameter in meters and t is the tablet thickness in meters.

The break-up, and dispersion of tablets was measured by the procedure of Example 1, using one tablet on the rotating sieve.

The results are set out in the following table:

| Compaction | A Tablets with Acetate.3H,O | | B Comparative tablets with citrate and PEG | |
|---|---|---|---|---|
| Force (kN) | Strength (DFS in kpa) | $T_{90}$ (minutes) | Strength (DFS in kpa) | $T_{90}$ (minutes) |
| 1 | 5.1 | 4.0 | — | — |
| 2 | 7.2 | 3.8 | 19.3 | 11.1 |
| 4 | 13.7 | 3.9 | 31 | 25 |
| 5 | 20.8 | 7.5 | 43 | 30 |

It can be seen that the tablets containing acetate trihydrate, made with 5 kN compaction force were almost equal in strength to the comparative tablets made at 2 kN force, but dispersed faster and did not require a process step of spraying polymer onto the powder.

EXAMPLE 4

Further tablets for fabric washing were made starting from the same base powder as in the previous example. This was mixed with sodium acetate trihydrate (as used in Example 1) and other detergent ingredients as follows:

| | |
|---|---|
| Base powder | 53.02% |
| Na-acetate 3 aq. | 23.63 |
| Perborate monohydrate | 11.2 |
| TAED (83%) | 4.3 |
| Antifoam granule | 3.42 |
| Na-disilicate (80%) | 1.5 |
| Enzymes | 1.5 |
| Phosphonate | 1.0 |
| Perfume | 0.43 |

35 g portions of the resulting composition were compacted into cylindrical tablets of 44 mm diameter using a Carver hand press as in the previous example, but with an applied force of 6 kN. Strength and dispersion time were measured as in the previous Example. The tablets were found to have DFS of 20.3 kPa and a $T_{90}$ of 0.9 minutes.

Visual observation confirmed that the tablets dispersed, leaving negligible residue on the sieve, within one minute.

EXAMPLE 5

Tablets are made, as in the preceding Example, using a base powder of the following composition:

| | Parts by weight |
|---|---|
| Linear alkylbenzene sulphonate | 8.0 |
| Nonionic detergent | 6.5 |
| Sodium carbonate | 3.5 |
| Soap | 1.0 |
| Sodium carboxymethyl cellulose | 0.5 |
| Zeolite A24 | 28.0 |
| Sodium acetate trihydrate | 3.0 |
| Fluorescer | 0.5 |
| Acrylate maleate copolymer | 2.0 |

EXAMPLE 6

Tablets for use in fabric washing were made, starting with a granulated base powder of the following composition:

| | % by weight |
|---|---|
| Coconut alkyl sulphate | 20.33 |
| Nonionic detergent ($C_{13-15}$ fatty alcohol 7EO) | 11.09 |
| Soap | 3.60 |
| Zeolite A24 | 42.42 |
| Sodium carboxymethyl cellulose | 1.68 |
| Sodium carbonate | 5.11 |
| Sodium citrate dihydrate | 6.37 |
| Moisture and other minor ingredients | 9.4 |

Samples of this powder were mixed with various materials to promote disintegration and other detergent ingredients as tabulated below.

| | % by weight |
|---|---|
| Base powder | 50.0 |
| Perborate monohydrate | 11.2 |

-continued

| | % by weight |
|---|---|
| TAED (83% active) granules | 4.35 |
| Phosphonate | 0.60 |
| Sodium carbonate | 2.0 |
| Na-disilicate (80%) | 3.7 |
| Antifoam granules | 2.5 |
| Fluorescer granules (15% active) | 1.0 |
| Acrylate maleate copolymer | 1.0 |
| Enzymes | 0.74 |
| Perfume | 0.45 |
| Disintegration promoter | 22.5 |

The various compositions were made into tablets and tested as in Example 3. The sodium acetate trihydrate was similar to that used for Examples 1 and 3. The materials used as disintegration promoter and the test results are set out in the table below.

| Disintegration promoter | Compaction force (kN) | Strength (DFS in kPa) | Dissolution ($T_{90}$ in minutes) |
|---|---|---|---|
| 22.5% Na-acetate trihydrate | 2 | 8.9 | 1.85 |
| | 4 | 26.5 | 3.25 |
| | 6 | 36.4 | 5.40 |
| 19.5% Na-acetate trihydrate with 3% PEG 1500 (as fine powder) | 2 | 13.0 | 1.65 |
| | 4 | 29.5 | 2.5 |
| | 6 | 47.7 | 2.8 |
| 14.5% Na-acetate trihydrate with 8% K-acetate | 2 | 19.6 | 1.6 |
| | 4 | 54.9 | 3.0 |
| | 6 | 113.9 | 5.3 |
| 14.5% Na-acetate trihydrate with 8% sucrose | 2 | 11.1 | 1.45 |
| | 4 | 23.1 | 3.1 |
| | 6 | 37.0 | 4.55 |
| 14.5% Na-acetate trihydrate with 8% urea | 2 | 9.4 | 1.8 |
| | 4 | 22.2 | 3.15 |
| | 6 | 33.8 | 5.05 |

EXAMPLE 7

Further tablets were made and tested using a similar procedure. The base powder was the same as that in Example 5. Samples of the base powder were mixed with various materials to promote disintegration, and other detergent components as in the following table

| | % by weight |
|---|---|
| Base powder | 50.0 |
| Perborate monohydrate | 14.3 |
| TAED (83% active) granules | 5.5 |
| Phosphonate | 0.65 |
| Sodium carbonate | 2.0 |
| Na-disilicate (80%) | 3.7 |
| Antifoam granules | 2.5 |
| Fluorescer granules (15% active) | 1.0 |
| Acrylate maleate copolymer | 1.0 |
| Enzymes | 0.90 |
| Perfume | 0.45 |
| Disintegration aid | 18 |

The various compositions were made into tablets and tested as in Example 3. Sodium acetate trihydrate was the same as that used in Examples 1, 3 and 5. The materials used as disintegration promoter and the test results are set out in the following table:

| Disintegration promoter | Compaction force (kN) | Strength (DFS in kPa) | Dissolution ($T_{90}$ in minutes) |
|---|---|---|---|
| 18% Na-acetate trihydrate | 2 | 11.0 | 1.2 |
| | 4 | 23.2 | 3.35 |
| | 6 | 33.4 | 5.0 |
| 18% potassium acetate | 2 | 26.4 | 0.9 |
| | 4 | 54.7 | 2.35 |
| | 6 | 76.8 | 4.3 |
| 10% Na-acetate trihydrate with 8% K-acetate | 2 | 23.6 | 1.75 |
| | 4 | 54.3 | 3.65 |
| | 6 | 78.9 | 8.6 |

EXAMPLE 8

Phosphate-containing tablets for use in fabric washing can be made, starting with a spray-dried base powder of the following composition:

| | % by weight |
|---|---|
| Sodium linear alkylbenzene sulphonate | 11.5 |
| Sodium tripolyphosphate | 44.8 |
| ($C_{13-15}$ fatty alcohol 7EO) | 8.2 |
| Sodium silicate | 11.8 |
| Soap | 1.1 |
| Sodium carboxymethyl cellulose | 0.9 |
| Acrylate/maleate copolymer | 3.2 |
| Sodium sulphate, moisture and minor ingredients | balance to 100% |

This powder is mixed with particles of sodium acetate trihydrate and other detergent ingredients as tabulated below.

| | % by weight |
|---|---|
| Base powder | 66.6 |
| Sodium perborate tetrahydrate | 10.0 |
| Tetraacetylethylenediamine (TAED) granules | 4.0 |
| Anti-foam granule | 1.5 |
| Enzymes | 0.8 |
| Phosphonate | 0.5 |
| Sodium carbonate | 2.6 |
| Sodium acetate trihydrate | 14.0 |

EXAMPLE 9

Sodium carbonate and bicarbonate were demonstrated to reduce caking of sodium acetate trihydrate, using the following test procedure:

Crystalline sodium acetate trihydrate (supplied by Verdugt) with average particle size 770 $\mu$m was mixed with sodium carbonate or sodium bicarbonate in varying amounts up to 5% by weight.

The sodium carbonate was light soda ash (supplied by Akzo). It was anhydrous and had an average particle size below 200 $\mu$m, estimated as 140 $\mu$m.

The sodium bicarbonate (supplied by Solvay) was likewise anhydrous and was passed through a 180 $\mu$m sieve before use. The average particle size of the sieved material was estimated to be about 90 $\mu$m.

3.5 kg quantities of sodium acetate trihydrate were mixed by hand with the sodium carbonate or bicarbonate. Any lumps present in the sodium acetate trihydrate were removed and broken up or discarded prior to weighing out the 3.5 kg quantity.

After mixing, the mixture was stored in a closed bucket for various periods at 20° C. or 37° C. Before and after storage a portion of the sodium acetate was poured through a sieve with 3.35 mm apertures. Material retained on the sieve was considered caked. It was weighed and expressed as a 3.35 mm apertures. The following results were obtained:

| | | % caked after storage period | | | | | |
|---|---|---|---|---|---|---|---|
| Additive | Temp (° C. ) | before storage | 1 day | 2 days | 3 days | 7 days | 33 days |
| none | 20 | 0 | | 15.4 | 22.0 | 30.4 | 51.0 |
| | 37 | 0 | 27.9 | 24.5 | 47.1 | 54 | 73.3 |
| 2.5% carbonate | 20 | 0 | 11.1 | 25.5 | 23.8 | 24.5 | 34.8 |
| | 37 | 0 | 22.9 | | 36.5 | 44.1 | 57.3 |
| 5% carbonate | 20 | 0 | 6.4 | 15.7 | 9.5 | 14.6 | 29.9 |
| | 37 | 0 | 22.3 | | 27.0 | 36.4 | 40.5 |

| | | % caked after storage period | | | |
|---|---|---|---|---|---|
| Additive | Temp (° C) | before storage | 10 days | 41 days | 43 days |
| 2% bicarbonate | 20 | 0 | 1.4 | 0.75 | |
| | 37 | 0 | | | 48.1 |

EXAMPLE 10

The previous example was repeated with further materials all of which were inorganic, as follows:

Alusil N, a commercial aluminosilicate flow aid available from Crosfields, mean particle size 6 μm.

Zeolite 4A, mean particle size in a range from 2 to 5 μm.

Zeolite A24, a maximum aluminium zeolite P available from Crosfields, mean particle size in a range from 0.7 to 1.5 μm Storage was for seven days in every case.

Material passing through the 3.35 mm sieve was tested for its stickiness by the following procedure referred to as "compression test". A cylindrical mould made in two halves is placed on a flat surface with its axis vertical. It then defines a cylindrical chamber 9 cm in diameter and 11 cm high. This is filled with the material to test. The material is next compressed within the mould by means of a 10 kg weight for two minutes. The weight and the mould are then removed to leave a free-standing cylindrical compact of the test material. Weight is progressively applied to the top of this compact until collapse. The result is expressed as the applied weight in grams.

The following results were obtained:

| | % caked | | | compression test (gm) | | |
|---|---|---|---|---|---|---|
| Additive | before storage | 7 days at 20° C. | 7 days at 37° C. | before storage | 7 days at 20° C. | 7 days at 37° C. |
| none | 0% | 40.9% | 64.6% | 952 | 707 | 1206 |
| 0.2% A24 | 0% | 0.6% | 7.9% | 2457 | 1959 | 2458 |
| 0.4% A24 | 0% | 1.0% | 7.7% | 2457 | 2457 | 2458 |
| 0.6% A24 | 0% | 0.7% | 3.7% | 2457 | 2457 | 2959 |
| 1% A24 | 0% | 0.1% | 0.35% | 2457 | 2208 | 2208 |
| 2% A24 | 0% | 0.3% | 0.4% | 2958 | 1708 | 2208 |

-continued

| | % caked | | | compression test (gm) | | |
|---|---|---|---|---|---|---|
| Additive | before storage | 7 days at 20° C. | 7 days at 37° C. | before storage | 7 days at 20° C. | 7 days at 37° C. |
| 0.6% 4A | 0% | 11.6% | 18.5% | 2209 | 1959 | 1959 |
| 0.6% Alusil-N | 0% | 0.9% | 1.3% | 1708 | 1457 | 1707 |

In can be seen from the results in this table that the application of these materials increases the stickiness of the material compared to sodium acetate trihydrate alone. In spite of this however, the caking into lumps is dramatically reduced.

EXAMPLE 11

Example 10 was repeated, using as additive polyethylene glycol of molecular weight 1500. This was in the form of fine powder which was passed through a 180 μm sieve before use. Its mean particle size was estimated as about 90 μm.

The following results were obtained:

| | % caked after | | compression test | |
|---|---|---|---|---|
| % PEG | 8 days at 20° C. | 8 days at 37° C. | 8 days at 20° C. | 8 days at 37° C. |
| none | 40.8% | 60.9% | 1099 | 1200 |
| 0.5% | 31.3% | 48.6% | 702 | 350 |
| 1% | 26.4% | 44.8% | 601 | 350 |
| 2% | 33.5% | 37.8% | 601 | 450 |
| 4% | 22.4% | 41.2% | low | 700 |

It can be seen from the above table that the PEG 1500 was effective to reduce caking. Moreover, it was observed that the lumps which were formed were relatively soft and easily broken whereas lumps formed when the sodium acetate trihydrate was not treated with polyethylene glycol were harder lumps. This difference is consistent with the compression test results where it can be seen that the application of polyethylene glycol reduced the stickiness of sodium acetate trihydrate.

EXAMPLE 12

Tablets suitable for use in water-softening were made from mixtures of zeolite granules and sodium acetate trihydrate with zeolite particles on the surface of the sodium acetate trihydrate crystals.

The zeolite granules were a commercial product available from Norsohaas under designation WLZ-10. Their composition was:

| | |
|---|---|
| Polycarboxylate | 9–11% |
| Zeolite A | 69.5–73.5% |
| Water | 17–20% |

The polycarboxylate was a copolymer of acrylate and maleate. Such polymers are known as water-soluble builders which enhance the water-softening efficacy of zeolite and also inhibit redeposition of soil from a wash liquor. In these granules the polycarboxylate serves as a binder for the zeolite powder.

The granulometry of WLZ-10 was determined as:

| | |
|---|---|
| Rosin Rammler average particle size | 625 microns |
| Rosin Rammler N value | 1.88 |
| Bulk density | 777 kg/m$^3$ |

The sodium acetate trihydrate was a technical grade from Verdugt having average particle size 770 $\mu$m and containing 5% of fines, smaller than 180$\mu$. The sodium acetate trihydrate was mixed with zeolite A24 as used in Example 2 in a quantity of 0.6% based on the weight of sodium acetate trihydrate.

The WLZ-10 zeolite granules and the sodium acetate trihydrate, with zeolite on its surface, were dry mixed in 3:1 weight ratio and then portions of each mixture were stamped into tablets.

EXAMPLE 13

Sodium acetate trihydrate (from Verdugt, mean particle size 770 $\mu$m) was mixed with 2% of its own weight of polyethylene glycol of mean molecular weight 1500 (PEG 1500) in the form of fine powder. This sodium acetate trihydrate plus PEG 1500 mixture was subsequently mixed with a granulated base powder and other ingredients as set out in the following tables. As a comparison sodium acetate trihydrate was used without admixed PEG 1500. This comparative formulation is also shown in the following tables.

| Granulated Base Powder | Parts by weight |
|---|---|
| Linear alkylbenzene sulphonate | 9.4 |
| Nonionic detergent | 4.1 |
| Sodium carbonate | 3.1 |
| Soap | 0.7 |
| Sodium carboxymethyl cellulose | 0.4 |
| Zeolite A24 (anhydrous) | 20.9 |
| Sodium acetate trihydrate | 2.7 |
| Moisture and non-detergent organic material | 3.7 |
| TOTAL | 45 |

| | % by weight | |
|---|---|---|
| | with PEG | comparative |
| Base powder | 45 | 45 |
| Sodium percarbonate | 15.3 | 15.3 |
| TAED (83% active) granules | 5.2 | 5.2 |
| Na-disilicate (80% silicate) | 3.6 | 3.6 |
| Phosphonate sequestrant | 0.7 | 0.7 |
| Soil release polymer | 1.1 | 1.1 |
| Antifoam granules (18% active) | 1.8 | 1.8 |
| Fluorescer granules (15% active) | 1.0 | 1.0 |
| Acrylate maleate copolymer | 1.3 | 1.3 |
| Sodium carbonate | 2.0 | 2.0 |
| Sodium acetate trihydrate + 2% PEG 1500 | 23.0 | — |
| Sodium acetate trihydrate | — | 23.0 |
| TOTAL | 100 | 100 |

Tablets were made from these two formulations, using a Carver laboratory press to make cylindrical tablets with a weight of 35 gm. Various amounts of force were used to stamp the tablets.

The resulting tablets were tested for tablet strength as in Example 3 and the diametral fracture stress was calculated from the measured data.

The disintegration and dissolution of tablets was tested by the procedure of Examples 1 and 3, with a single tablet placed on the plastic sieve. As before demineralised water at ambient temperature of 20° C. The water conductivity is monitored until it reached a constant value. The time for dissolution of the tablets is taken as the time ($T_{90}$) for change in the water conductivity to reach 90% of its final magnitude.

The results obtained are set out in the following table in which "comp." denotes the comparative tablets without PEG.

| Compaction force applied (kN) | $F_f$ (Newtons) comp | $F_f$ (Newtons) with PEG | DFS (kPa) comp | DFS (kPa) with PEG | $T_{90}$ (minutes) comp | $T_{90}$ (minutes) with PEG |
|---|---|---|---|---|---|---|
| 0 | | | | | 1.25 | 1.4 |
| 4 | 15.6 | 13.5 | 9.5 | 8.1 | 2.1 | 1.85 |
| 9 | 36.5 | 34.8 | 24.5 | 23.6 | 2.5 | 3.0 |
| 14 | 53.1 | 55.3 | 37.1 | 38.6 | 3.35 | 3.5 |

In the above table, zero compaction force denotes the particulate formulation prior to compaction.

It can be seen from this table that the presence of the PEG 1500 has very little effect on the tablet properties.

EXAMPLE 14

The procedure of the previous example was repeated using sodium acetate trihydrate which was mixed before use with 1% or 2% of its own weight of zeolite A24. This zeolite was as described in Example 2. Comparative tablets were made using sodium acetate trihydrate which had not been mixed with other material before use. The following results were obtained:

| Compaction force applied (kN) | $F_f$ (Newtons) zeolite percentage none | $F_f$ 1% | $F_f$ 2% | $T_{90}$ (minutes) zeolite percentage none | $T_{90}$ 1% | $T_{90}$ 2% |
|---|---|---|---|---|---|---|
| 0 | | | | 1.5 | 1.45 | 1.3 |
| 3.9 | 21.2 | 14.6 | 13.2 | 2.1 | 2.1 | 1.8 |
| 8.3 | 43.5 | 35.8 | 33.9 | 3.4 | 2.85 | 3.0 |
| 13.3 | 61.6 | 57.7 | 45.3 | 5.45 | 4.15 | 4.2 |

It can be seen that here again the use of a small percentage of zeolite on the sodium acetate trihydrate to prevent caking does not have a serious deleterious effect on the tablet properties. The incorporation of sodium acetate trihydrate leads to a considerable reduction in the time for tablet dissolution, compared to tablets which do not include this material, and this benefit is also obtained when the sodium acetate trihydrate is treated beforehand with particles of zeolite as in this example or particles of PEG 1500 as in the preceding example.

What is claimed is:

1. A tablet of a compacted particulate composition having enhanced tablet strength and speed of disintegration, wherein the tablet or a region thereof comprises from 15% to 90% by weight of a water-softening agent present in particles of the composition, and 10 to 35% by weight of sodium acetate trihydrate present in second particles of the composition which second particles are separate from but mixed with said particles containing water-softening agent.

2. A tablet according to claim 1 wherein the water-softening agent is water-insoluble.

3. A tablet according to claim 2 wherein the tablet or said region thereof contains 10% to 35% by weight of sodium acetate trihydrate, optionally together with sodium citrate dihydrate, such that the total quantity of sodium acetate trihydrate and sodium citrate dihydrate does not exceed 50% by weight of the tablet or said region thereof.

4. A tablet according to claim 1 wherein the tablet or said region thereof contains from 50% to 90% by weight of water-insoluble water-softening agent and from 10% to 30% by weight of said sodium acetate trihydrate.

5. A tablet according to claim 1 wherein sodium acetate trihydrate has a mean particle size of over 250 $\mu$m.

6. A tablet according to claim 5 wherein the tablet or said region thereof contains at least 13% by weight of sodium acetate trihydrate with a mean particle size over 300 $\mu$m.

7. A tablet according to claim 1 wherein the tablet or said region thereof also contains 5 to 50% by weight of one or more detergent active compounds.

8. A tablet according to claim 7 wherein the detergent-active is present in particles containing water-softening agent.

9. A tablet according to claim 7 wherein the detergent-active is present in particles containing water-softening agent, and the tablet or said region thereof contains at least 10% by weight of sodium acetate trihydrate with mean particle size over 250 $\mu$m.

10. A tablet according to claim 1 wherein the water-softening agent is water-insoluble, and is alkali metal aluminosilicate, crystalline layered silicate or a mixture thereof.

11. A tablet according to claim 1 wherein said second particles further comprise smaller particles of carbonate, bicarbonate, aluminosilicate or polyethylene glycol at the surface of the crystals of sodium acetate trihydrate, wherein the smaller particles have a mean particle size which is not more than one tenth or one thirtieth the mean size of the crystals.

12. A process for the production of a tablet of a compacted particulate composition having enhanced tablet strength and speed of disintegration, said process comprising mixing (i) first particles containing a water-softening agent, and (ii) second particles containing a water-soluble crystalline salt which is sodium acetate trihydrate, the amount of the water-soluble crystalline salt being 10% to 35% by weight of the tablet and compacting the resulting mixed composition into tablets or regions of tablets.

13. A process according to claim 12 wherein said second particles (ii) comprise smaller particles of carbonate, bicarbonate, aluminosilicate or polyethylene glycol at the surface of the crystals of the said crystalline salt wherein the smaller particles have a mean particle size which is not more than one tenth or one thirtieth the mean size of the crystals.

14. A process according to claim 13 which includes a step of applying the smaller particles to the surface of crystals of the crystalline salt (ii) before the salt is mixed with other ingredients of the composition.

15. A process for the production of a tablet of a compacted particulate composition having enhanced tablet strength and speed of disintegration, said process comprising applying smaller particles of carbonate, bicarbonate, aluminosilicate or polyethylene glycol to the surface of crystals of a water-soluble crystalline salt which is sodium acetate trihydrate, wherein the smaller particles have a mean particle size which is not more than one tenth or one thirtieth the means size of the crystals; thereafter mixing a water-softening agent with said crystalline salt and compacting the resulting mixed composition into tablets or regions of tablets, wherein said water-soluble crystalline salt is present in amounts from 10% to 35% by weight of the tablet.

16. A process according to claim 15 wherein the mixed composition and the tablet or tablet regions compacted therefrom contain from 15% to 90% by weight of a water-insoluble water-softening agent.

17. A process according to claim 15 wherein the mixed composition and the tablets or tablet regions compacted therefrom comprise first particles which contain from 15% to 60% by weight of the composition of water-insoluble water-softening agent together with 5% to 50% by weight of the composition of one or more detergent-active compounds and second particles which contain from 10% to 35% by weight of the composition of said crystalline salt.

18. A process according to claim 15 wherein said crystalline salt has a mean particle size over 300 $\mu$m.

* * * * *